US011236748B2

(12) United States Patent
King

(10) Patent No.: US 11,236,748 B2
(45) Date of Patent: Feb. 1, 2022

(54) COMPRESSOR HAVING DIRECTED SUCTION

(71) Applicant: Emerson Climate Technologies, Inc., Sidney, OH (US)

(72) Inventor: Joshua S. King, Anna, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 35 days.

(21) Appl. No.: 16/803,576

(22) Filed: Feb. 27, 2020

(65) Prior Publication Data

US 2020/0309124 A1 Oct. 1, 2020

Related U.S. Application Data

(60) Provisional application No. 62/826,427, filed on Mar. 29, 2019.

(51) Int. Cl.

| | |
|---|---|
| ***F04C 18/02*** | (2006.01) |
| ***F04C 23/00*** | (2006.01) |
| ***F04C 29/12*** | (2006.01) |

(52) U.S. Cl.

CPC ..... *F04C 18/0207* (2013.01); *F04C 18/0215* (2013.01); *F04C 23/008* (2013.01); *F04C 29/12* (2013.01); *F04C 2240/30* (2013.01); *F04C 2250/101* (2013.01)

(58) Field of Classification Search

CPC ..... F04C 29/12; F04C 2250/10–101; F04C 15/06; F04C 18/0207–0292; F04C 2/025; F01C 1/0207–0292

See application file for complete search history.

(56) References Cited

U.S. PATENT DOCUMENTS

| | | | |
|---|---|---|---|
| 1,365,530 | A | 1/1921 | Moore |
| 2,142,452 | A | 1/1939 | Merrill |
| 2,157,918 | A | 5/1939 | Rankin |
| 3,075,686 | A | 1/1963 | Steinhagen |

(Continued)

FOREIGN PATENT DOCUMENTS

| | | | |
|---|---|---|---|
| CN | 1208821 | A | 2/1999 |
| CN | 1278892 | A | 1/2001 |

(Continued)

OTHER PUBLICATIONS

International Search Report regarding International Application No. PCT/US2020/037004, dated Sep. 21, 2020.

(Continued)

*Primary Examiner* — Laert Dounis

(74) *Attorney, Agent, or Firm* — Harness, Dickey & Pierce, P.L.C.

(57) ABSTRACT

A compressor that includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes an externally located slot and a suction inlet. The conduit includes a first end that defines an inlet opening and a second end that defines an outlet opening. The second end includes a connecting arm that has a first boss extending therefrom. The second end snaps into engagement with the second scroll member such that the first boss is received within the slot of the second scroll member.

17 Claims, 6 Drawing Sheets

(56) References Cited

U.S. PATENT DOCUMENTS

| | | | |
|---|---|---|---|
| 3,817,661 | A | 6/1974 | Ingalls et al. |
| 3,870,440 | A | 3/1975 | Zuercher, Jr. |
| 4,313,715 | A | 2/1982 | Richardson, Jr. |
| 4,343,599 | A | 8/1982 | Kousokabe |
| 4,365,941 | A | 12/1982 | Tojo et al. |
| 4,401,418 | A | 8/1983 | Fritchman |
| 4,412,791 | A | 11/1983 | Lal |
| 4,477,229 | A | 10/1984 | Kropiwnicki et al. |
| 4,496,293 | A | 1/1985 | Nakamura et al. |
| 4,564,339 | A | 1/1986 | Nakamura et al. |
| 4,592,703 | A | 6/1986 | Inaba et al. |
| 4,609,334 | A | 9/1986 | Muir et al. |
| 4,648,811 | A | 3/1987 | Tahata et al. |
| 4,696,629 | A | 9/1987 | Shiibayashi et al. |
| 4,759,696 | A | 7/1988 | Ishiai |
| 4,767,293 | A | 8/1988 | Caillat et al. |
| 4,793,775 | A | 12/1988 | Peruzzi |
| 4,838,769 | A | 6/1989 | Gannaway |
| 4,877,382 | A | 10/1989 | Caillat et al. |
| 4,915,554 | A | 4/1990 | Serizawa et al. |
| 5,007,809 | A | 4/1991 | Kimura et al. |
| 5,030,073 | A | 7/1991 | Serizawa et al. |
| 5,055,010 | A | 10/1991 | Logan |
| 5,064,356 | A | 11/1991 | Horn |
| 5,108,274 | A | 4/1992 | Kakuda et al. |
| 5,114,322 | A | 5/1992 | Caillat et al. |
| 5,197,868 | A | 3/1993 | Caillat et al. |
| 5,219,281 | A | 6/1993 | Caillat et al. |
| 5,240,391 | A | 8/1993 | Ramshankar et al. |
| 5,288,211 | A | 2/1994 | Fry |
| 5,295,813 | A | 3/1994 | Caillat et al. |
| 5,306,126 | A | 4/1994 | Richardson, Jr. |
| 5,344,289 | A | 9/1994 | Fasce |
| 5,366,352 | A | 11/1994 | Deblois et al. |
| 5,427,511 | A | 6/1995 | Caillat et al. |
| 5,435,700 | A | 7/1995 | Park |
| 5,439,361 | A | 8/1995 | Reynolds et al. |
| 5,476,369 | A | 12/1995 | Fowlkes et al. |
| 5,531,078 | A | 7/1996 | Day et al. |
| 5,533,875 | A | 7/1996 | Crum et al. |
| 5,593,294 | A | 1/1997 | Houghtby et al. |
| 5,597,293 | A | 1/1997 | Bushnell et al. |
| 5,645,408 | A | 7/1997 | Fujio et al. |
| 5,745,992 | A | 5/1998 | Caillat et al. |
| 5,772,411 | A | 6/1998 | Crum et al. |
| 5,772,416 | A | 6/1998 | Caillat et al. |
| 5,931,649 | A | 8/1999 | Caillat et al. |
| 5,992,033 | A | 11/1999 | Scarborough |
| 6,000,917 | A | 12/1999 | Smerud et al. |
| 6,017,205 | A | 1/2000 | Weatherston et al. |
| 6,131,406 | A | 10/2000 | Barowsky et al. |
| 6,139,295 | A | 10/2000 | Utter et al. |
| 6,158,995 | A | 12/2000 | Muramatsu et al. |
| 6,164,934 | A | 12/2000 | Niihara et al. |
| 6,168,404 | B1 | 1/2001 | Gatecliff |
| 6,174,150 | B1 | 1/2001 | Tsubono et al. |
| 6,244,834 | B1 | 6/2001 | Matsuda et al. |
| 6,261,071 | B1 | 7/2001 | Williams et al. |
| 6,293,776 | B1 | 9/2001 | Hahn et al. |
| 6,352,418 | B1 | 3/2002 | Kohsokabe et al. |
| 6,364,643 | B1 | 4/2002 | Milliff |
| 6,402,485 | B2 | 6/2002 | Hong et al. |
| 6,454,538 | B1 | 9/2002 | Witham et al. |
| 6,474,964 | B2 | 11/2002 | De Bernardi et al. |
| 6,537,019 | B1 | 3/2003 | Dent |
| 6,685,441 | B2 | 2/2004 | Nam |
| 6,709,244 | B2 | 3/2004 | Pham |
| 6,736,607 | B2 | 5/2004 | Ginies et al. |
| 6,814,546 | B2 | 11/2004 | Sekiguchi |
| 6,857,808 | B1 | 2/2005 | Sugimoto et al. |
| 6,887,050 | B2 | 5/2005 | Haller |
| 6,896,496 | B2 | 5/2005 | Haller et al. |
| 7,018,183 | B2 | 3/2006 | Haller et al. |
| 7,018,184 | B2 | 3/2006 | Skinner et al. |
| 7,063,523 | B2 | 6/2006 | Skinner |
| 7,094,043 | B2 | 8/2006 | Skinner |
| 7,108,494 | B2 | 9/2006 | Nam |
| 7,137,775 | B2 | 11/2006 | Hopkins |
| 7,147,443 | B2 | 12/2006 | Ogawa et al. |
| 7,207,787 | B2 | 4/2007 | Liang et al. |
| 7,311,501 | B2 | 12/2007 | Wehrenberg et al. |
| 7,318,710 | B2 | 1/2008 | Lee et al. |
| 7,416,395 | B2 | 8/2008 | Sato |
| 7,503,755 | B2 | 3/2009 | Lai et al. |
| RE40,830 | E | 7/2009 | Caillat |
| 7,686,592 | B2 | 3/2010 | Inoue et al. |
| 7,699,589 | B2 | 4/2010 | Terauchi et al. |
| 7,708,536 | B2 | 5/2010 | Ginies et al. |
| 7,771,180 | B2 | 8/2010 | Cho et al. |
| 7,905,715 | B2 | 3/2011 | Hiwata et al. |
| 8,133,043 | B2 | 3/2012 | Duppert |
| 8,152,503 | B2 | 4/2012 | Haller |
| 8,348,647 | B2 | 1/2013 | Kiyokawa et al. |
| 8,814,537 | B2 | 8/2014 | Ignatiev et al. |
| 8,974,198 | B2 | 3/2015 | Schaefer et al. |
| 8,992,186 | B2 | 3/2015 | Silveira et al. |
| 9,051,934 | B2 | 6/2015 | Fraser |
| 9,057,270 | B2 | 6/2015 | Strawn et al. |
| 9,366,462 | B2 | 6/2016 | Perevozchikov et al. |
| 10,094,600 | B2 | 10/2018 | Doepker et al. |
| 2001/0006603 | A1 | 7/2001 | Hong et al. |
| 2001/0055536 | A1 | 12/2001 | Bernardi et al. |
| 2002/0090305 | A1 | 7/2002 | Myung et al. |
| 2003/0072662 | A1 | 4/2003 | Reinhart |
| 2004/0057843 | A1 | 3/2004 | Haller et al. |
| 2004/0057849 | A1 | 3/2004 | Skinner et al. |
| 2004/0057857 | A1 | 3/2004 | Skinner |
| 2004/0126258 | A1 | 7/2004 | Lai et al. |
| 2004/0166008 | A1 | 8/2004 | Lai et al. |
| 2004/0228751 | A1 | 11/2004 | Shin |
| 2005/0129534 | A1 | 6/2005 | Lee |
| 2006/0073061 | A1 | 4/2006 | Sato |
| 2006/0078452 | A1 | 4/2006 | Park et al. |
| 2006/0127262 | A1 | 6/2006 | Shin et al. |
| 2006/0177335 | A1 | 8/2006 | Hwang et al. |
| 2006/0222545 | A1 | 10/2006 | Nam et al. |
| 2006/0222546 | A1 | 10/2006 | Lee et al. |
| 2006/0245967 | A1 | 11/2006 | Gopinathan |
| 2006/0275150 | A1 | 12/2006 | Barth |
| 2007/0178002 | A1 | 8/2007 | Hiwata et al. |
| 2007/0183914 | A1 | 8/2007 | Gopinathan |
| 2007/0237664 | A1 | 10/2007 | Joo et al. |
| 2009/0110586 | A1 | 4/2009 | Brabek et al. |
| 2009/0136344 | A1 | 5/2009 | Chen et al. |
| 2009/0229303 | A1 | 9/2009 | Iversen et al. |
| 2010/0021330 | A1 | 1/2010 | Haller |
| 2012/0134859 | A1 | 5/2012 | Duppert |
| 2012/0148433 | A1 | 6/2012 | Liang et al. |
| 2013/0026749 | A1 | 1/2013 | O'Brien et al. |
| 2013/0039792 | A1 | 2/2013 | Hiratsuka et al. |
| 2013/0089451 | A1 | 4/2013 | Ahn et al. |
| 2013/0108496 | A1 | 5/2013 | Nakai et al. |
| 2013/0129549 | A1 | 5/2013 | Sakuda et al. |
| 2016/0348675 | A1 | 12/2016 | Ishii et al. |
| 2017/0002812 | A1 | 1/2017 | Duppert |
| 2019/0041106 | A1 | 2/2019 | Piscopo |
| 2019/0041107 | A1 | 2/2019 | Piscopo et al. |
| 2020/0392953 | A1 | 12/2020 | Stover et al. |

FOREIGN PATENT DOCUMENTS

| | | | |
|---|---|---|---|
| CN | 1354326 | A | 6/2002 |
| CN | 1371444 | A | 9/2002 |
| CN | 1482365 | A | 3/2004 |
| CN | 1629476 | A | 6/2005 |
| CN | 1779244 | A | 5/2006 |
| CN | 1869443 | A | 11/2006 |
| CN | 101235932 | A | 8/2008 |
| CN | 101415947 | A | 4/2009 |
| CN | 102216617 | A | 10/2011 |
| CN | 202926625 | U | 5/2013 |
| CN | 203453064 | U | 2/2014 |
| CN | 104999172 | A | 10/2015 |
| CN | 204934897 | U | 1/2016 |

(56) References Cited

FOREIGN PATENT DOCUMENTS

| | | | |
|---|---|---|---|
| CN | 205064214 | U | 3/2016 |
| CN | 107246393 | A | 10/2017 |
| EP | 0438243 | A1 | 7/1991 |
| EP | 0529660 | A1 | 3/1993 |
| EP | 1338795 | A1 | 8/2003 |
| EP | 1541868 | A1 | 6/2005 |
| JP | S62182486 | A | 8/1987 |
| JP | S63183773 | A | 7/1988 |
| JP | H04347387 | A | 12/1992 |
| JP | H05157064 | A | 6/1993 |
| JP | H05302581 | A | 11/1993 |
| JP | H07197893 | A | 8/1995 |
| JP | H08319965 | A | 12/1996 |
| JP | H11141470 | A | 5/1999 |
| JP | 2001165065 | A | 6/2001 |
| JP | 2002155875 | A | 5/2002 |
| JP | 2002155877 | A | 5/2002 |
| JP | 2002235524 | A | 8/2002 |
| JP | 2003120539 | A | 4/2003 |
| JP | 2005188353 | A | 7/2005 |
| JP | 2006144729 | A | 6/2006 |
| JP | 2008223605 | A | 9/2008 |
| JP | 2009019570 | A | 1/2009 |
| JP | 2010043627 | A | 2/2010 |
| JP | 2011236861 | A | 11/2011 |
| KR | 20010064538 | A | 7/2001 |
| KR | 20010068323 | A | 7/2001 |
| KR | 20020024708 | A | 4/2002 |
| KR | 20080019509 | A | 3/2008 |
| KR | 20090045352 | A | 5/2009 |
| KR | 20140034345 | A | 3/2014 |
| KR | 20180107482 | A | 10/2018 |
| KR | 20190025250 | A | 3/2019 |
| WO | WO-2006109475 | A1 | 10/2006 |
| WO | WO-2007025883 | A1 | 3/2007 |
| WO | WO-2007114582 | A1 | 10/2007 |
| WO | WO-2008102940 | A1 | 8/2008 |
| WO | WO-2009090856 | A2 | 7/2009 |
| WO | WO-2011147005 | A1 | 12/2011 |

OTHER PUBLICATIONS

Written Opinion of the International Searching Authority regarding International Application No. PCT/US2020/037004, dated Sep. 21, 2020.
Notice of Allowance regarding U.S. Appl. No. 16/154,097, dated Oct. 27, 2020.
Notice of Allowance regarding U.S. Appl. No. 16/154,364, dated Jan. 6, 2021.
U.S. Appl. No. 15/930,785, filed May 13, 2020, Robert C. Stover et al.
International Search Report regarding International Application No. PCT/BR2010/000179, dated Sep. 1, 2010.
Written Opinion of the International Searching Authority regarding International Application No. PCT/BR2010/000179, dated Sep. 1, 2010.
International Search Report regarding International Application No. PCT/US2012/056067, dated Feb. 19, 2013.
Written Opinion of the International Searching Authority regarding International Application No. PCT/US2012/056067, dated Feb. 19, 2013.
Restriction Requirement regarding U.S. Appl. No. 13/610,274, dated Aug. 16, 2013.
Search Report regarding European Patent Application No. 10851912.5, dated Nov. 15, 2013.
Office Action regarding Japanese Patent Application No. 2013-511484, dated Nov. 19, 2013.
Office Action regarding U.S. Appl. No. 13/610,274, dated Nov. 27, 2013.
International Search Report regarding International Application No. PCT/US2013/059612, dated Dec. 9, 2013.
Written Opinion of the International Searching Authority regarding International Application No. PCT/US2013/059612, dated Dec. 9, 2013.
Office Action regarding U.S. Appl. No. 13/699,207, dated Dec. 18, 2013.
Notice of Allowance regarding U.S. Appl. No. 13/610,274, dated Mar. 24, 2014.
Notice of Allowance regarding U.S. Appl. No. 13/610,274, dated Jul. 18, 2014.
Office Action regarding European Patent Application No. 10851912.5, dated Jul. 18, 2014.
Office Action regarding U.S. Appl. No. 13/699,207, dated Jul. 24, 2014.
Office Action regarding Chinese Patent Application No. 201080066999.X, dated Sep. 17, 2014.
Notice of Allowance regarding U.S. Appl. No. 13/699,207, dated Nov. 24, 2014.
Office Action regarding Chinese Patent Application No. 201210376153.7, dated Dec. 3, 2014. Translation provided by Unitalen Attorneys At Law.
Restriction Requirement regarding U.S. Appl. No. 14/025,887, dated Jan. 5, 2015.
Restriction Requirement regarding U.S. Appl. No. 13/930,834, dated Jan. 29, 2015.
Office Action regarding U.S. Appl. No. 14/025,887, dated Mar. 26, 2015.
Notice of Allowance regarding U.S. Appl. No. 13/930,834, dated Apr. 24, 2015.
Office Action regarding Chinese Patent Application No. 201210376153.7, dated Jul. 3, 2015. Translation provided by Unitalen Attorneys at Law.
Office Action regarding U.S. Appl. No. 14/025,887, dated Jul. 23, 2015.
Office Action regarding Chinese Patent Application No. 201310286638.1, dated Jul. 27, 2015. Translation provided by Unitalen Attorneys at Law.
Office Action regarding U.S. Appl. No. 14/025,887, dated Dec. 3, 2015.
Office Action regarding Chinese Patent Application No. 201210376153.7, dated Dec. 28, 2015. Translation provided by Unitalen Attorneys at Law.
Office Action regarding Chinese Patent Application No. 201310286638.1, dated Jan. 21, 2016. Translation provided by Unitalen Attorneys at Law.
Office Action regarding Chinese Patent Application No. 201380047907.7, dated Mar. 8, 2016. Translation provided by Unitalen Attorneys at Law.
Notice of Allowance regarding U.S. Appl. No. 14/025,887, dated Apr. 12, 2016.
Search Report regarding European Patent Application No. 13836817.0, dated Jun. 1, 2016.
Office Action regarding Korean Patent Application No. 10-2012-7033723, dated Aug. 22, 2016.
Office Action regarding Chinese Patent Application No. 201380047907.7, dated Nov. 8, 2016. Translation provided by Unitalen Attorneys at Law.
Office Action regarding Chinese Patent Application No. 201380047907.7, dated Apr. 12, 2017. Translation provided by Unitalen Attorneys at Law.
Office Action regarding U.S. Appl. No. 15/180,570, dated Oct. 5, 2017.
Office Action regarding U.S. Appl. No. 15/180,570, dated Mar. 22, 2018.
Notice of Allowance regarding U.S. Appl. No. 15/180,570, dated May 31, 2018.
Notice of Allowance regarding U.S. Appl. No. 15/180,570, dated Jul. 19, 2018.
Office Action regarding Indian Patent Application No. 476/MUMNP/2015, dated Sep. 7, 2018.
Office Action regarding Indian Patent Application No. 10655/DELNP/2012, dated Sep. 28, 2018.
Office Action regarding European Patent Application No. 13836817.0, dated Sep. 10, 2019.

(56) References Cited

OTHER PUBLICATIONS

U.S. Appl. No. 16/941,060, filed Jul. 28, 2020, Keith J. Reinhart et al.
Office Action regarding U.S. Appl. No. 16/154,097, dated Jun. 23, 2020.
International Search Report regarding International Application No. PCT/US2020/025564, dated Jul. 8, 2020.
Written Opinion of the International Searching Authority regarding International Application No. PCT/US2020/025564, dated Jul. 8, 2020.
Office Action regarding U.S. Appl. No. 16/154,364, dated Aug. 17, 2020.
Non-Final Office Action regarding U.S. Appl. No. 16/941,060 dated Aug. 2, 2021.

COMPRESSOR HAVING DIRECTED SUCTION

CROSS-REFERENCE TO RELATED APPLICATIONS

This application claims the benefit of U.S. Provisional Application No. 62/826,427, filed on Mar. 29, 2019. The entire disclosure of the above application is incorporated herein by reference.

FIELD

The present disclosure relates to a compressor having directed suction.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes an externally located slot and a suction inlet. The conduit includes a first end that defines an inlet opening and a second end that defines an outlet opening. The conduit directing working fluid into the suction inlet. The second end includes a connecting arm that has a first boss extending therefrom. The second end snaps into engagement with the second scroll member such that the first boss is received within the slot of the second scroll member.

In some configurations of the compressor of the above paragraph, the connecting arm is arcuate.

In some configurations of the compressor of any one or more of the above paragraphs, the connecting arm includes a second boss extending therefrom. The second boss is received within the slot of the second scroll member when the second end snaps into engagement with the second scroll member.

In some configurations of the compressor of any one or more of the above paragraphs, the first boss and the second boss extend from opposing ends of the connecting arm.

In some configurations of the compressor of any one or more of the above paragraphs, the first boss and the second boss prevent radial movement of the conduit relative to the second scroll member.

In some configurations of the compressor of any one or more of the above paragraphs, the conduit includes a plurality of resiliently flexible tabs extending from the connecting arm.

In some configurations of the compressor of any one or more of the above paragraphs, the plurality of resiliently flexible tabs are positioned between the first and second bosses.

In some configurations of the compressor of any one or more of the above paragraphs, the second scroll member includes externally located grooves formed therein. The resiliently flexible tabs snap into engagement with respective grooves to prevent axial movement of the conduit relative to the second scroll member.

In some configurations of the compressor of any one or more of the above paragraphs, the conduit includes a resiliently flexible tab extending from the connecting arm.

In some configurations of the compressor of any one or more of the above paragraphs, the second scroll member includes an externally located groove formed therein. The resiliently flexible tab snaps into engagement with the groove to prevent axial movement of the conduit relative to the second scroll member.

In some configurations of the compressor of any one or more of the above paragraphs, the second scroll member includes a wall. The slot is formed in a top surface of the wall and the groove is formed in a lateral surface of the wall.

In some configurations of the compressor of any one or more of the above paragraphs, the second end of the conduit includes a bridge that extends at least partially into the suction inlet and is in engagement with the wall to prevent rotational movement of the conduit relative to the second scroll member.

In another form, the present disclosure provides a compressor that includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes an externally located first groove, an externally located second groove and a suction inlet formed between the first and second grooves. The conduit includes a first end that defines an inlet opening and a second end that defines an outlet opening. The conduit directing working fluid into the suction inlet. The second end includes a first resiliently flexible tab and a second resiliently flexible tab. The first resiliently flexible tab snaps into engagement with the first groove and the second resiliently flexible tab snaps into engagement with the second groove.

In some configurations of the compressor of the above paragraph, the first and second resiliently flexible tabs prevent axial movement of the conduit relative to the second scroll member when the first and second resiliently flexible tabs snap into engagement with the first and second grooves, respectively.

In some configurations of the compressor of any one or more of the above paragraphs, the second scroll member includes a wall. The first and second grooves are formed in a lateral surface of the wall.

In some configurations of the compressor of any one or more of the above paragraphs, the second end of the conduit includes a bridge that extends at least partially into the suction inlet and is in engagement with the wall to prevent rotational movement of the conduit relative to the second scroll member.

In some configurations of the compressor of any one or more of the above paragraphs, the bridge is positioned between the first and second resiliently flexible tabs.

In yet another form, the present disclosure provides a compressor that includes a shell assembly, a compression mechanism and a conduit. The shell assembly defines a chamber. The compression mechanism is disposed within the chamber of the shell assembly and includes a first scroll member and a second scroll member in meshing engagement with each other. The second scroll member includes an externally located slot, an externally located groove and a suction inlet. The conduit includes a first end that defines an inlet opening and a second end that defines an outlet opening. The conduit directing working fluid into the suction inlet. The second end includes a boss, a resiliently flexible tab and a bridge. The boss is received within the slot and the bridge is in engagement with the suction inlet when the resiliently flexible tab snaps into engagement with the groove.

In some configurations of the compressor of the above paragraph, the second end includes a connecting arm. The boss and the resiliently flexible tab extend from the connecting arm.

In some configurations of the compressor of any one or more of the above paragraphs, the connecting arm is arcuate.

In some configurations of the compressor of any one or more of the above paragraphs, the boss prevents radial movement of the conduit relative to the second scroll member when received in the slot, the resiliently flexible tab prevents axial movement of the conduit relative to the second scroll member when snapped into engagement with the groove, and the bridge prevents rotational movement of the conduit relative to the second scroll member when in engagement with the suction inlet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
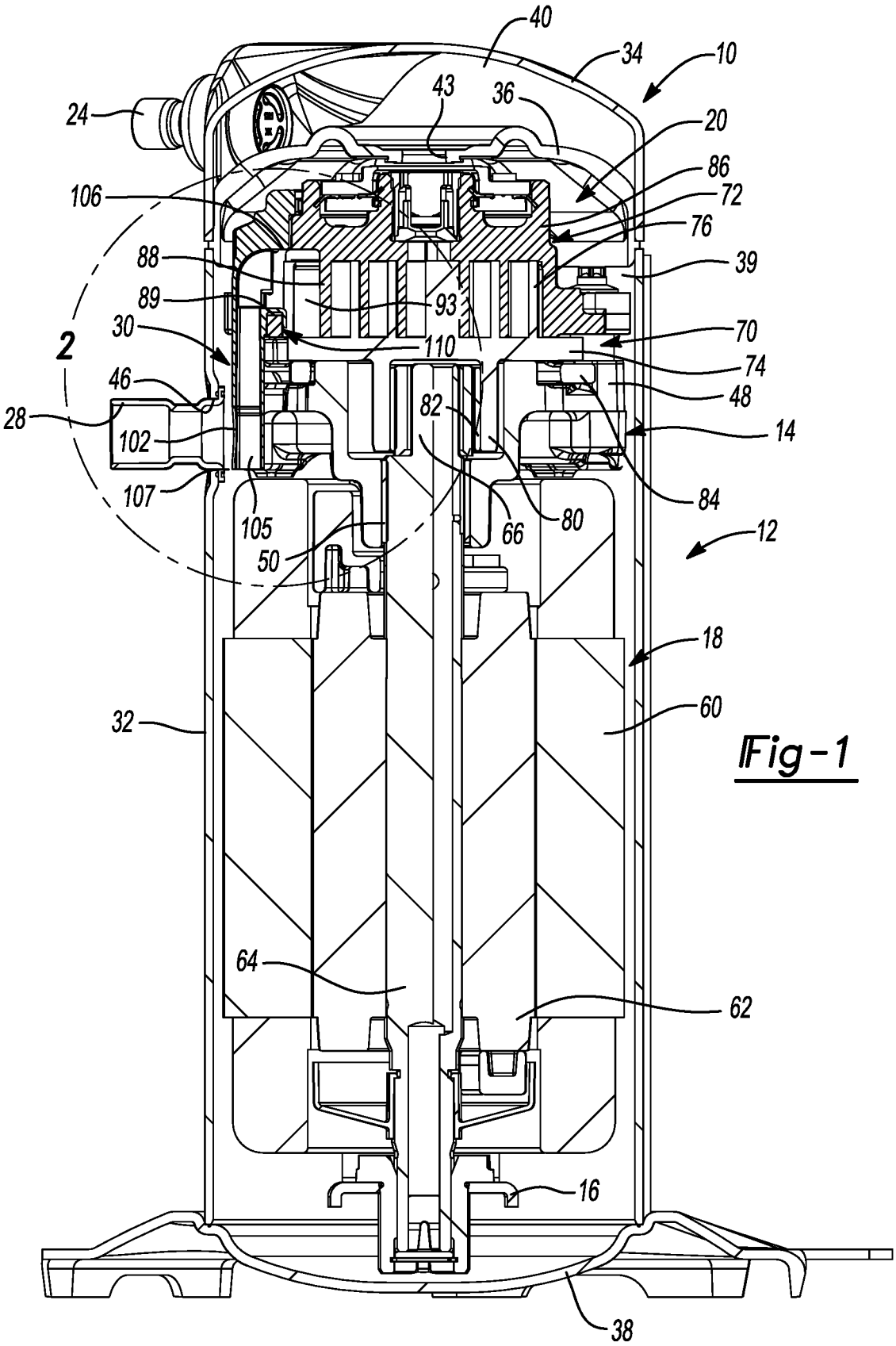
FIG. 1 is a cross-sectional view of a compressor having a suction conduit according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided and may include a hermetic shell assembly 12, first and second bearing housing assemblies 14, 16, a motor assembly 18, a compression mechanism 20, a discharge port or fitting 24, a suction port or fitting 28, and a suction conduit 30.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32 and the base 38 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40. The suction fitting 28 may be attached to the shell assembly 12 at an opening 46.

As shown in FIG. 1, the first bearing housing assembly 14 may be disposed within the suction-pressure chamber and may be fixed relative to the shell 32. The first bearing housing assembly 14 may include a first main bearing housing 48 and a first bearing 50. The first main bearing housing 48 may house the first bearing 50 therein. The first main bearing housing 48 may fixedly engage the shell 32 and may axially support the compression mechanism 20.

As shown in FIG. 1, the motor assembly 18 may be disposed within the suction-pressure chamber 39 and may include a stator 60 and a rotor 62. The stator 60 may be press fit into the shell 32. The rotor 62 may be press fit on a drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat.

As shown in FIG. 1, the compression mechanism 20 may be disposed within the suction-pressure chamber 39 and may include an orbiting scroll 70 and a non-orbiting scroll 72. The first scroll member or orbiting scroll 70 may include an end plate 74 and a spiral wrap 76 extending therefrom. A cylindrical hub 80 may project downwardly from the end plate 74 and may include a drive bushing 82 disposed therein. The drive bushing 82 may include an inner bore (not numbered) in which the crank pin 66 is drivingly disposed. The crank pin flat may drivingly engage a flat surface in a portion of the inner bore to provide a radially compliant driving arrangement. An Oldham coupling 84 may be engaged with the orbiting and non-orbiting scrolls 70, 72 to prevent relative rotation therebetween.

Figure 2:
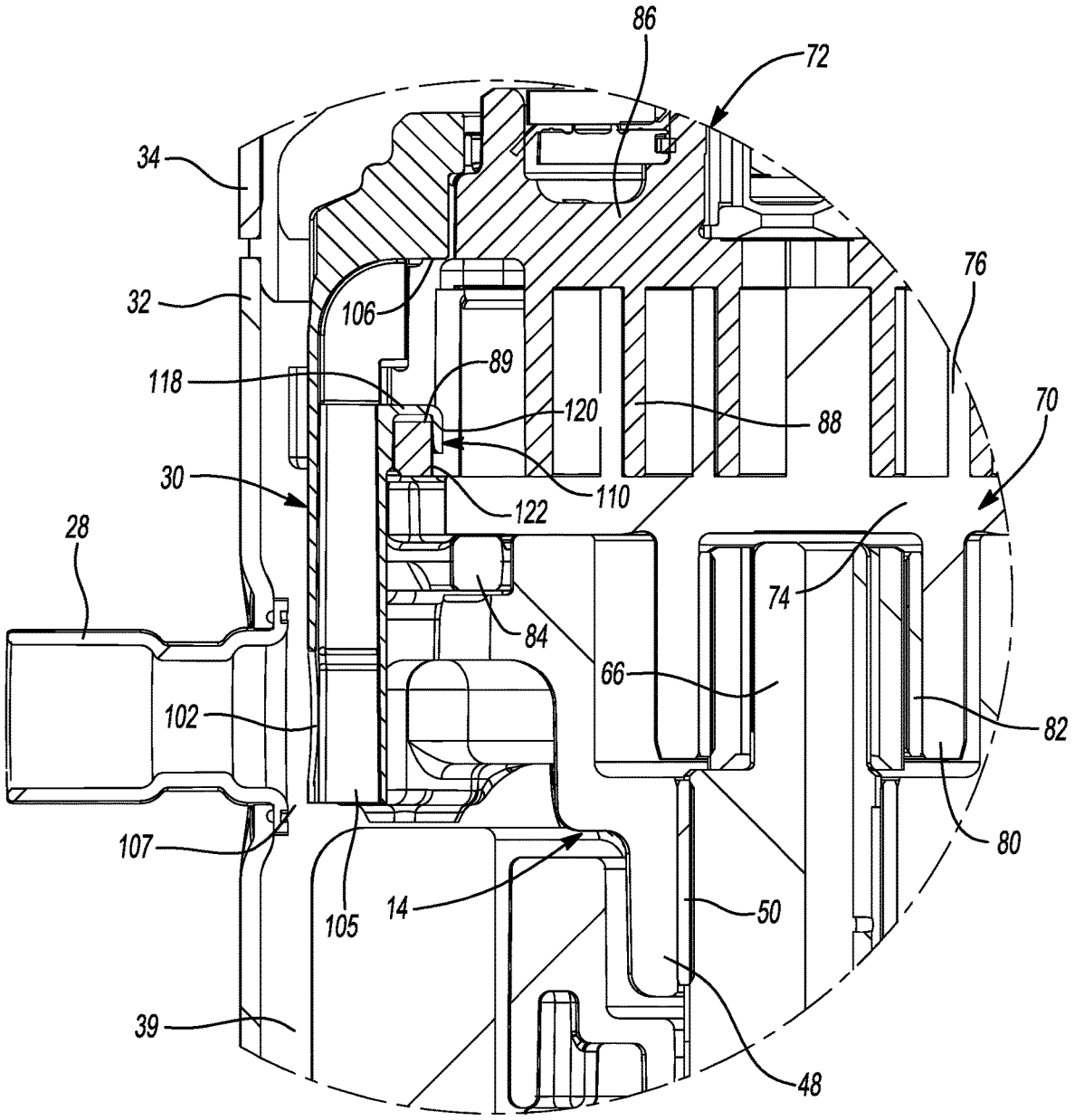
FIG. 2 is a close-up view of a portion of the compressor indicated as area 2 in FIG. 1.
Figure 3:
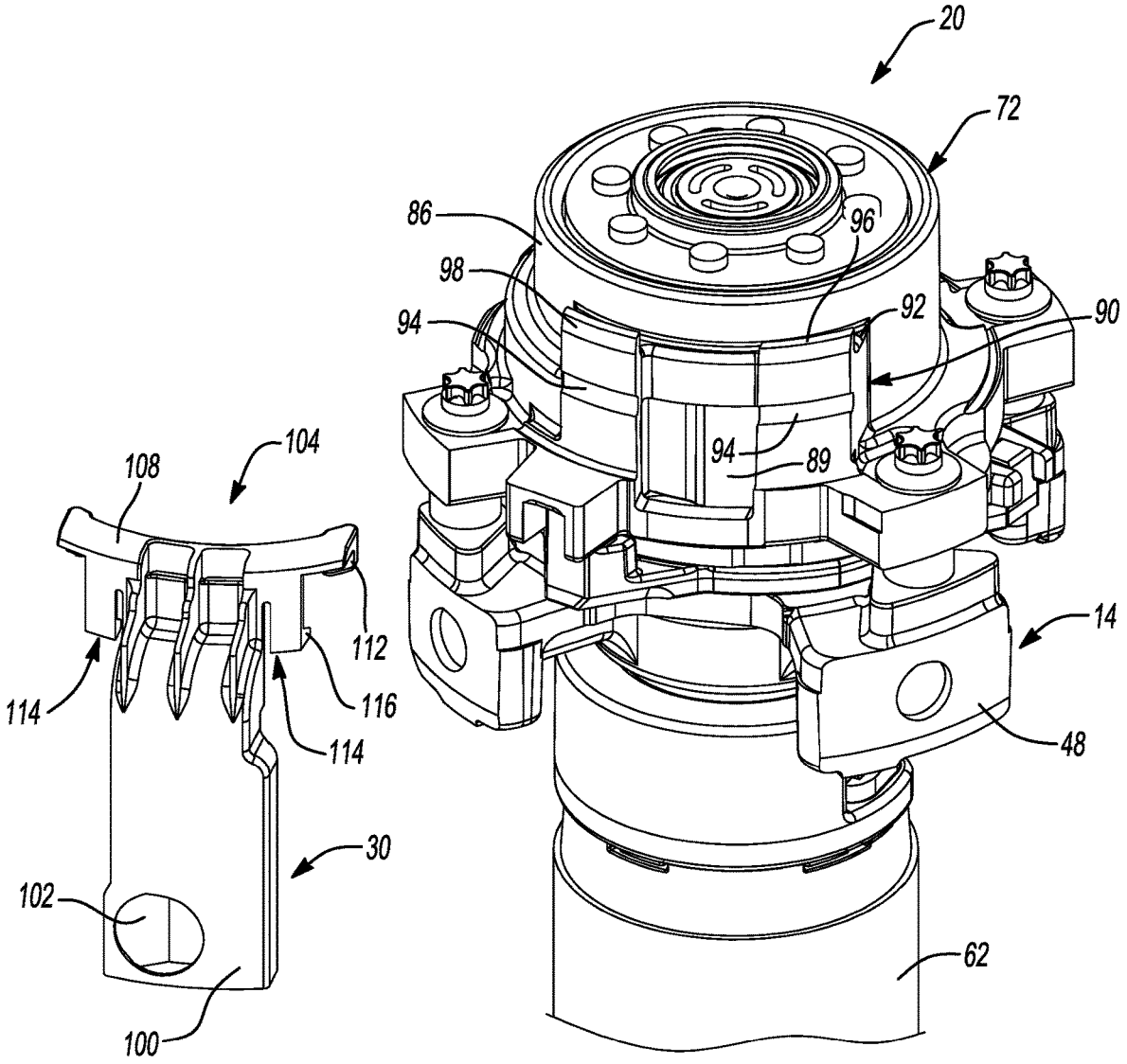
FIG. 3 is a perspective view of a suction conduit and a non-orbiting scroll of a compression mechanism shown disconnected from each other.

As shown in FIG. 1, the second scroll member or non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. As shown in FIGS. 1-3, a suction inlet 89 may be formed in the non-orbiting scroll 72 and may provide fluid communication between the suction conduit 30 and a radially outermost fluid pocket 93 formed by the spiral wraps 76, 88.

Figure 4:
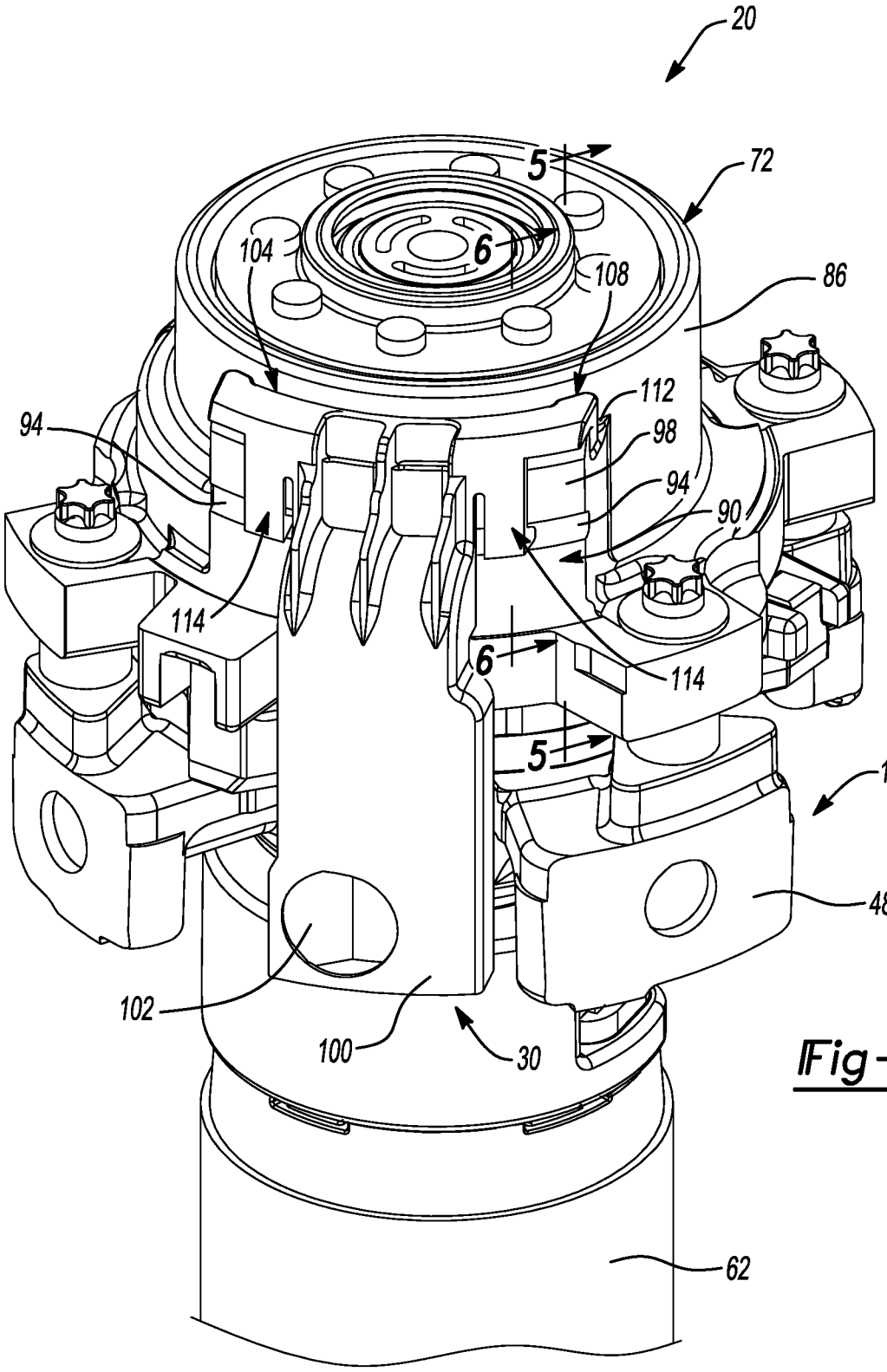
FIG. 4 is a perspective view of the suction conduit and the non-orbiting scroll of the compression mechanism shown connected to each other.
Figure 5:
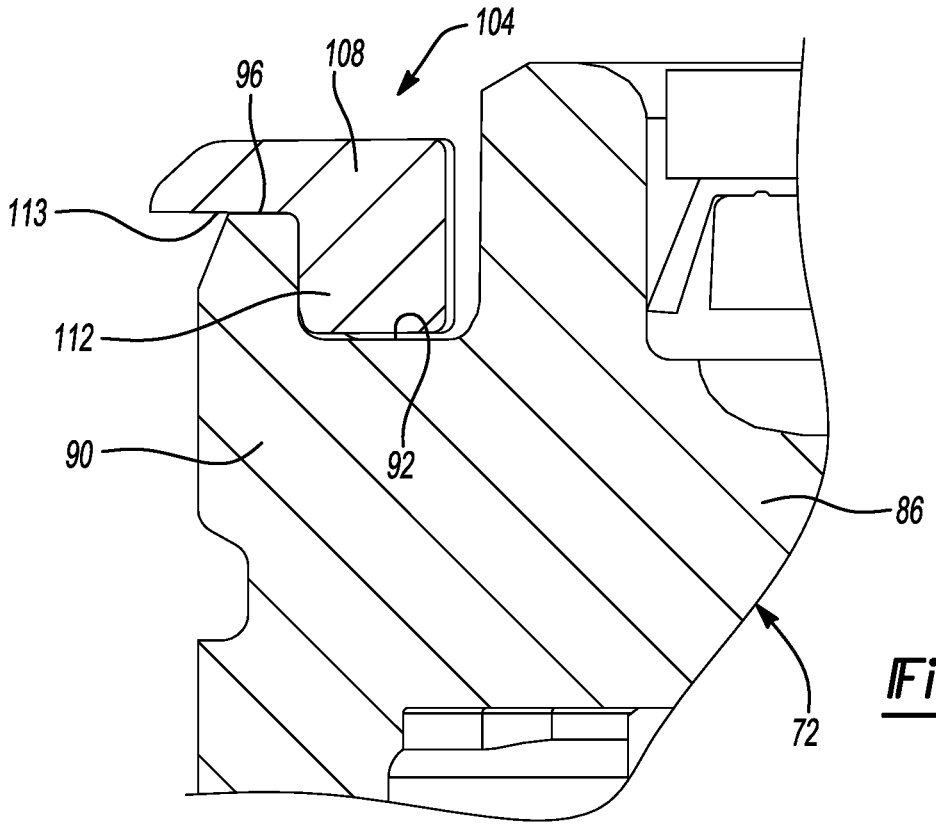
FIG. 5 is a partial cross-sectional view of the suction conduit and the non-orbiting scroll connected to each other taken along line 5-5 of FIG. 4.
Figure 6:
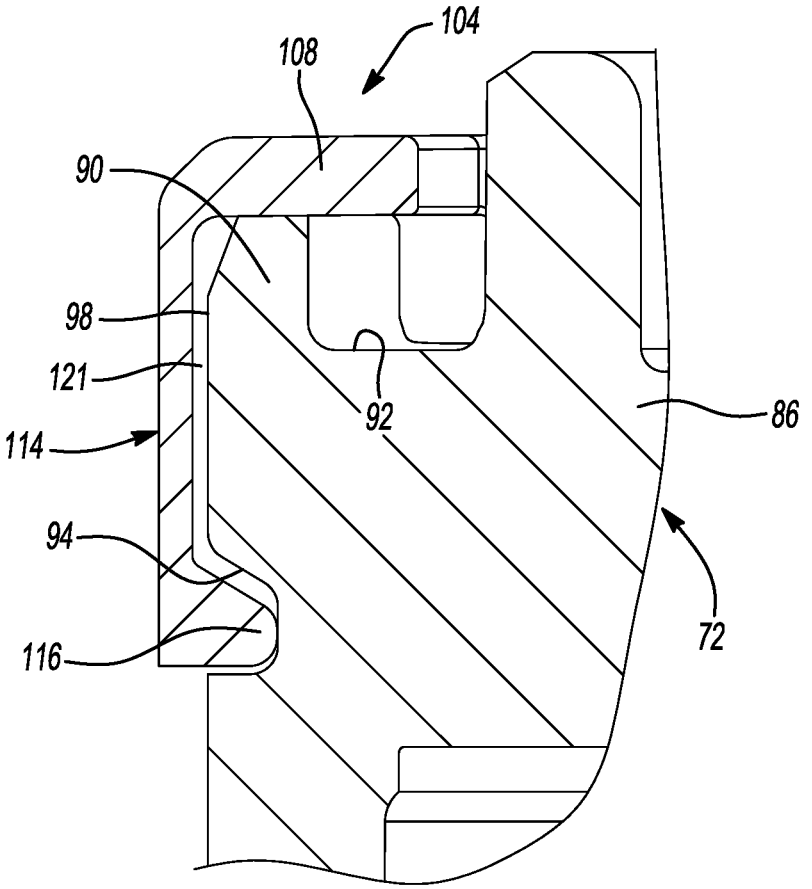
FIG. 6 is another partial cross-sectional view of the suction conduit and the non-orbiting scroll connected to each other taken along line 6-6 of FIG. 4.
Figure 7:
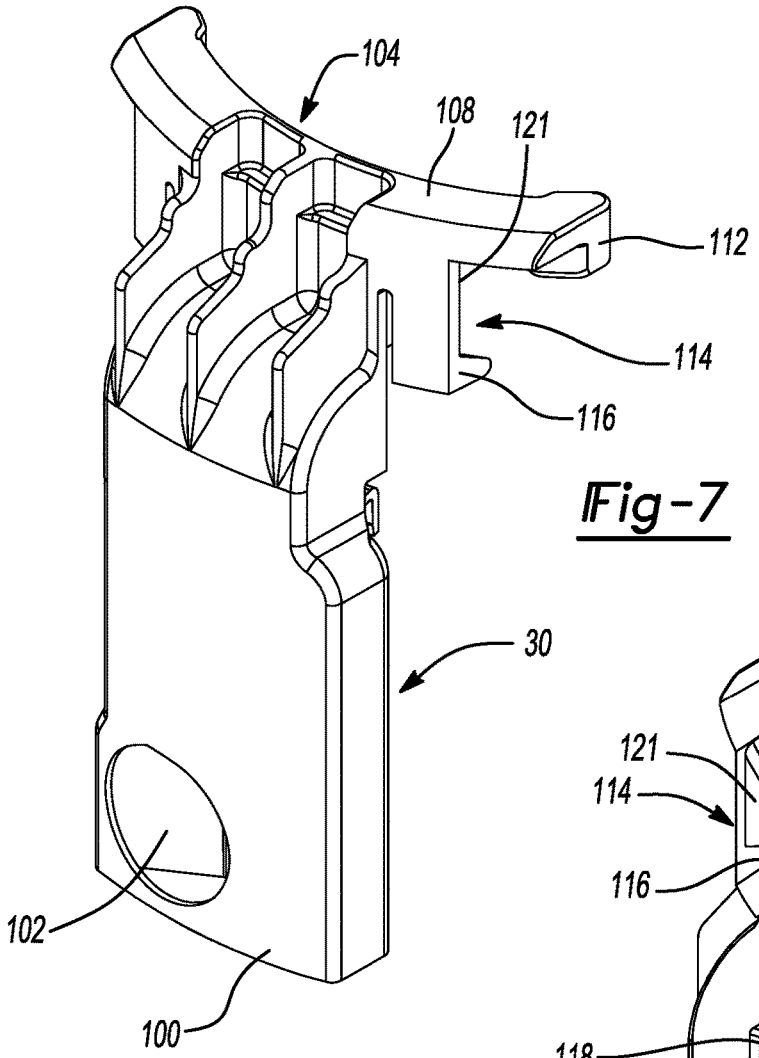
FIG. 7 is a perspective view of the suction conduit.

With reference to FIGS. 3-6, the non-orbiting scroll 72 also has a wall 90 that is integral with the end plate 86 and may include an externally located first slot or groove 92 (FIGS. 3 and 5; the first slot 92 is located outside of the suction inlet 89) and a plurality of externally located second slots or grooves 94 (FIGS. 3, 4 and 6; the second slots 94 are located outside of the suction inlet 89). The first slot 92 may be machined, for example, in a top surface 96 of the wall 90. The plurality of second slots 94 may be machined, for example, in a lateral surface 98 of the wall 90 (i.e., the lateral surface 98 of the wall 90 is perpendicular to the top surface 96 of the wall 90). The wall 90 may also define the suction inlet 89, which may be spaced apart from the first slot 92. The suction inlet 89 may also be positioned between two of the second grooves 94.

The suction conduit 30 may direct working fluid at a suction-pressure from the suction fitting 28 to the suction inlet 89 of the non-orbiting scroll 72 so that working fluid can be directed into the radially outermost fluid pocket 93 and subsequently compressed by the compression mechanism 20. As shown in FIGS. 1, 2 and 4, the suction conduit 30 may snap into engagement with the wall 90 of the non-orbiting scroll 72. The suction conduit 30 may be injection molded or otherwise formed from a polymeric or metallic material, for example. The suction conduit 30 may include a first end 100 and a second end 104. A circular-shaped an inlet opening 102 (FIGS. 1-4, 7 and 8) and an outlet opening 105 (FIGS. 1, 2 and 8) may be formed at or near the first end 100 and an outlet opening 106 (FIGS. 1, 2 and 8) may be formed at or near the second end 104. The first end 100 may be adjacent to the suction fitting 28 (i.e., the first end 100 may contact the suction fitting 28 or may be spaced apart from the suction fitting 28). In some configurations, the inlet opening 102 may be concentric with and/or generally aligned with the suction fitting 28.

The outlet opening 105 may provide fluid communication between the suction conduit 30 and the suction-pressure chamber 39. A portion of working fluid that flows into the suction conduit 30 through the inlet opening 102 may exit the suction conduit 30 through the outlet opening 105. From the outlet opening 105, the working fluid may flow into the suction-pressure chamber 39 and may absorb heat from the motor assembly 18 and/or other components. This fluid may then re-enter the suction conduit 30 through the inlet opening 102 (via a gap 107 between the suction conduit 30 and the shell 32) and may flow into the suction inlet 89 and/or back through the outlet opening 105.

The second end 104 may snap into engagement with the wall 90 of the non-orbiting scroll 72 and may include a connecting arm 108 disposed at or near a top of the outlet opening 106 and a bridge 110 (FIGS. 1, 2 and 8) disposed at or near a bottom of the outlet opening 106. The connecting arm 108 may be arcuate and may include axially extending bosses 112 at opposing ends thereof (i.e., the bosses 112 extend in a direction parallel to a longitudinal axis of the shaft 64). As shown in FIG. 5, each boss 112 may be received in the first slot 92 of the non-orbiting scroll 72 when the second end 104 snaps into engagement with the wall 90 of the non-orbiting scroll 72. In this way, the suction conduit 30 is prevented from moving in a radial direction relative to the non-orbiting scroll 72 (i.e., the suction conduit 30 is prevented from moving in a direction perpendicular to the longitudinal axis of the shaft 64). As shown in FIG. 5, a bottom surface 113 of the connecting arm 108 may abut against the top surface 96 of the wall 90 when the second end 104 snaps into engagement with the wall 90 of the non-orbiting scroll 72.

Figure 8:
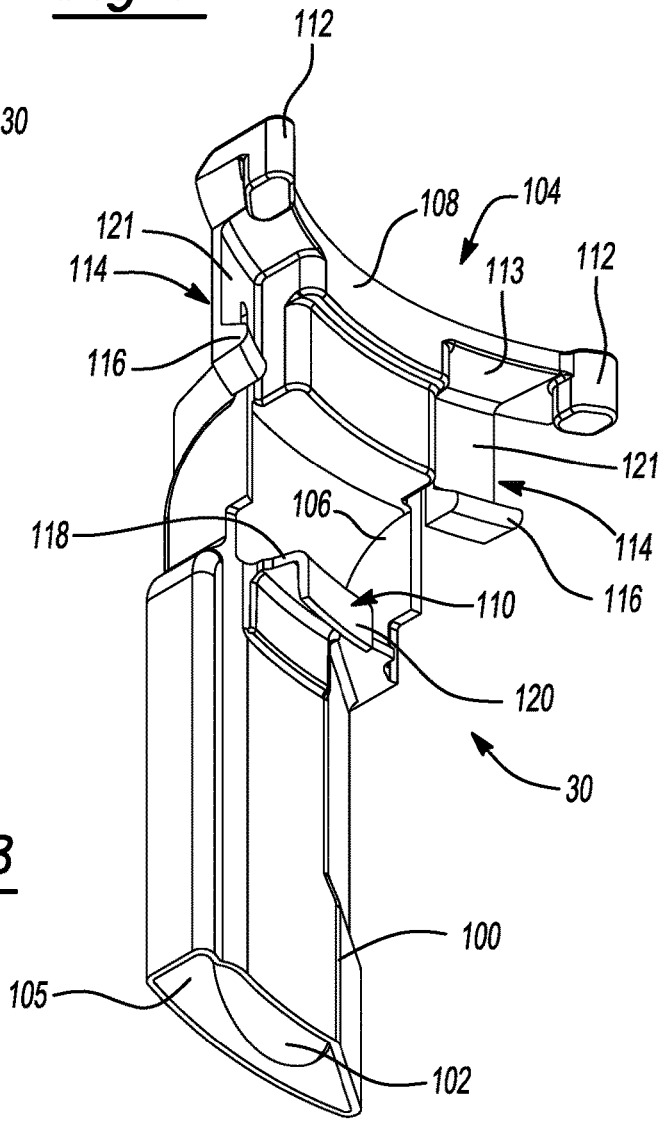
FIG. 8 is another perspective view of the suction conduit.

The connecting arm 108 may also include a plurality of resiliently flexible tabs 114 having barbed tips 116. The plurality of resiliently flexible tabs 114 may extend from the connecting arm 108 in an axial direction (i.e., the plurality of resiliently flexible tabs 114 extend in a direction parallel to the longitudinal axis of the shaft 64). As shown in FIG. 8, the plurality of resiliently flexible tabs 114 are positioned between the bosses 112. In some configurations, the plurality of resiliently flexible tabs 114 may be positioned outside of the bosses 112 (i.e., the bosses 112 are disposed between the flexible tabs 114). The flexible tabs 114 may snap into engagement with the wall 90 of the non-orbiting scroll 72 (i.e., the barbed tips 116 of the flexible tabs 114 may snap into engagement with corresponding second grooves 94 and a surface 121 of the flexible tabs 114 may abut against the lateral surface 98 of the wall 90) such that the suction conduit 30 is prevented from moving in the axial direction relative to the non-orbiting scroll 72.

The bridge 110 may be positioned between two of the plurality of flexible tabs 114 and may include a first member 118 and a second member 120 extending perpendicularly to the first member 118. When the barbed tips 116 of the flexible tabs 114 snap into engagement with the corresponding second grooves 94, the bridge 110 may extend at least partially into the suction inlet 89 and the second member 120 may abut an inner surface 122 of the wall 90 (FIGS. 1 and 2). In this way, the suction conduit 30 may be prevented from rotating relative to the non-orbiting scroll 72 and may be prevented from moving in the radial direction relative to the non-orbiting scroll 72.

The suction conduit 30 of the present disclosure provides the benefit of eliminating fasteners (e.g., screws, bolts, etc.) and other components (e.g., compression limiters) needed to attach the suction conduit 30 to the non-orbiting scroll 72. The suction conduit 30 of the present disclosure also provides the benefit of reducing the time required to assemble the suction conduit 30 and the non-orbiting scroll 72 to each other.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly defining a chamber;

a compression mechanism disposed within the chamber of the shell assembly and including a first scroll member and a second scroll member in meshing engagement with each other, the second scroll member including an externally located slot and a suction inlet; and a conduit including a first end defining an inlet opening and a second end defining an outlet opening, the conduit directing working fluid into the suction inlet, the second end includes a connecting arm having a first boss extending therefrom, the second end snaps into engagement with the second scroll member such that the first boss is received within the slot of the second scroll member, wherein the conduit includes a resiliently flexible tab extending from the connecting arm, wherein the second scroll member includes an externally located groove formed therein, and wherein the resiliently flexible tab snaps into engagement with the groove to prevent axial movement of the conduit relative to the second scroll member, and wherein the second scroll member includes a wall, and wherein the slot is formed in a top surface of the wall and the groove is formed in a lateral surface of the wall.

2. The compressor of claim 1, wherein the connecting arm is arcuate.

3. The compressor of claim 1, wherein the connecting arm includes a second boss extending therefrom, and wherein the second boss is received within the slot of the second scroll member when the second end snaps into engagement with the second scroll member.

4. The compressor of claim 3, wherein the first boss and the second boss extend from opposing ends of the connecting arm.

5. The compressor of claim 4, wherein the first boss and the second boss prevent radial movement of the conduit relative to the second scroll member.

6. The compressor of claim 4, wherein the conduit includes a plurality of resiliently flexible tabs extending from the connecting arm.

7. The compressor of claim 6, wherein the plurality of resiliently flexible tabs are positioned between the first and second bosses.

8. The compressor of claim 7, wherein the second scroll member includes externally located grooves formed therein, and wherein the resiliently flexible tabs snap into engagement with respective grooves to prevent axial movement of the conduit relative to the second scroll member.

9. The compressor of claim 1, wherein the second end of the conduit includes a bridge that extends at least partially into the suction inlet and is in engagement with the wall to prevent rotational movement of the conduit relative to the second scroll member.

10. A compressor comprising:

a shell assembly defining a chamber;

a compression mechanism disposed within the chamber of the shell assembly and including a first scroll member and a second scroll member in meshing engagement with each other, the second scroll member includes an externally located first groove, an externally located second groove and a suction inlet formed between the first and second grooves; and a conduit including a first end defining an inlet opening and a second end defining an outlet opening, the conduit directing working fluid into the suction inlet, the second end includes a first resiliently flexible tab and a second resiliently flexible tab, the first resiliently flexible tab snaps into engagement with the first groove and the second resiliently flexible tab snaps into engagement with the second groove, wherein the second scroll member includes a wall, and wherein the first and second grooves are formed in a lateral surface of the wall.

11. The compressor of claim 10, wherein the first and second resiliently flexible tabs prevent axial movement of the conduit relative to the second scroll member when the first and second resiliently flexible tabs snap into engagement with the first and second grooves, respectively.

12. The compressor of claim 10, wherein the second end of the conduit includes a bridge that extends at least partially into the suction inlet and is in engagement with the wall to prevent rotational movement of the conduit relative to the second scroll member.

13. The compressor of claim 12, wherein the bridge is positioned between the first and second resiliently flexible tabs.

14. A compressor comprising:

a shell assembly defining a chamber;

a compression mechanism disposed within the chamber of the shell assembly and including a first scroll member and a second scroll member in meshing engagement with each other, the second scroll member including an externally located slot, an externally located groove and a suction inlet; and a conduit including a first end defining an inlet opening and a second end defining an outlet opening, the conduit directing working fluid into the suction inlet, the second end includes a boss, a resiliently flexible tab and a bridge, the boss is received within the slot and the bridge is in engagement with the suction inlet when the resiliently flexible tab snaps into engagement with the groove, wherein the second scroll member includes a wall, and wherein the slot is formed in a top surface of the wall and the groove is formed in a lateral surface of the wall.

15. The compressor of claim 14, wherein the second end includes a connecting arm, and wherein the boss and the resiliently flexible tab extend from the connecting arm.

16. The compressor of claim 15, wherein the connecting arm is arcuate.

17. The compressor of claim 14, wherein the boss prevents radial movement of the conduit relative to the second scroll member when received in the slot, the resiliently flexible tab prevents axial movement of the conduit relative to the second scroll member when snapped into engagement with the groove, and the bridge prevents rotational movement of the conduit relative to the second scroll member when in engagement with the suction inlet.

* * * * *